US008517708B2

(12) United States Patent
Kobayashi et al.

(10) Patent No.: US 8,517,708 B2
(45) Date of Patent: Aug. 27, 2013

(54) FUEL PUMP WITH AXIAL SLIDE GAP

(75) Inventors: Atsushige Kobayashi, Nagoya (JP); Yoshitaka Wakamatsu, Gamagori (JP)

(73) Assignee: Denso Corporation, Kariya (JP)

( * ) Notice: Subject to any disclaimer, the term of this patent is extended or adjusted under 35 U.S.C. 154(b) by 672 days.

(21) Appl. No.: 12/761,519

(22) Filed: Apr. 16, 2010

(65) Prior Publication Data

US 2010/0266436 A1 Oct. 21, 2010

(30) Foreign Application Priority Data

Apr. 16, 2009 (JP) ..... 2009-100233

(51) Int. Cl.
*F01C 1/00* (2006.01)
*F04D 5/00* (2006.01)

(52) U.S. Cl.
USPC ..... 418/259; 415/55.1; 415/224

(58) Field of Classification Search
USPC ..... 418/229, 230, 259, 268, 269; 415/224, 415/53.1–53.3, 55.1–55.7
See application file for complete search history.

(56) References Cited

FOREIGN PATENT DOCUMENTS

| | | | |
|---|---|---|---|
| JP | 2005-127290 | | 5/2005 |
| JP | 2008-95560 | | 4/2008 |
| JP | 2008095560 A | * | 4/2008 |

OTHER PUBLICATIONS

Japanese Office Action dated Feb. 1, 2011, issued in corresponding Japanese Application No. 2009-100233 with English Translation.

* cited by examiner

*Primary Examiner* — Mary A Davis
(74) *Attorney, Agent, or Firm* — Nixon & Vanderhye P.C.

(57) ABSTRACT

A fuel pump includes an impeller and a cover. The impeller includes a ring portion, which is annular and is placed radially outward of blades. The cover has an arcuate pump flow passage. An enlarged space is formed in a cover side slide surface of the cover. The enlarged space is communicated with the pump flow passage and has an axial gap size, which is axially measured between an axial bottom surface of the enlarged space and an axial end surface of the ring portion and is larger than that of an axial slide gap between the slide surface and the axial end surface of the ring portion.

4 Claims, 5 Drawing Sheets

FUEL PUMP WITH AXIAL SLIDE GAP

CROSS REFERENCE TO RELATED APPLICATION

This application is based on and incorporates herein by reference Japanese Patent Application No. 2009-100233 filed on Apr. 16, 2009.

BACKGROUND OF THE INVENTION

1. Field of the Invention

The present invention relates to a fuel pump, which draws fuel and discharges the drawn fuel after pressurizing the drawn fuel.

2. Description of Related Art

For example, Japanese Unexamined Patent Publication No. 2005-127290A teaches a fuel pump that includes a rotatable member and a flow passage member. The rotatable member is configured into a generally circular disk form and includes a plurality of blades and a ring portion. The blades are arranged one after another in a circumferential direction. The ring portion is annular and is placed radially outward of the blades. The flow passage member includes a receiving portion (receiving chamber) and a flow passage groove. The receiving portion rotatably receives the rotatable member. The flow passage groove forms a pump flow passage that conducts the fuel in a rotational direction of the rotatable member and pressurizes the fuel in cooperation with the rotatable member upon rotation of the rotatable member. The flow passage groove is configured into an arcuate form arcuately extending in the circumferential direction.

In the above fuel pump, which has the rotatable member including the ring portion, which is annular and is placed radially outward of the blades, the rotatable member can be rotated while the axial end surface of the ring portion slides along the inner wall surface of the receiving portion. Therefore, in the pressurizing process of the fuel, it is possible to limit or minimize a leakage of the fuel from the pump flow passage to a radially outer side of the rotatable member where the fuel pressure is lower than that of the pump flow passage.

That is, a pump efficiency can be improved. Here, the pump efficiency is expressed by $(P \times Q)/(T \times N)$. In this equation, "T" denotes a torque of a motor device, which drives the rotatable member, and "N" denotes a rotational speed of the motor device. Furthermore, "P" denotes a fuel pressure of the discharged fuel, and "Q" denotes the amount of the discharged fuel.

However, since the axial slide gap, which is formed between the axial end surface of the ring portion and the slide surface provided in the inner wall surface of the receiving portion, is made very small, contaminants, which are contained in the fuel and are drawn into this axial slide gap, may possibly cause an increase in wearing of the rotatable member and the flow passage member and/or an increase in the slide resistance between the rotatable member and the flow passage member to result in a deterioration of the pump efficiency.

In the case of the fuel pump recited in Japanese Unexamined Patent Publication No. 2005-127290A, a discharge port is formed to axially oppose the axial end surface of the ring portion, so that the portion of the pump flow passage, which is located adjacent to the discharge port, radially extends across the axial end surface of the ring portion.

In the case of the pump flow passage constructed in the above-described manner, the contaminants, which are drawn into the axial slide gap, are dragged by the rotatable member upon the rotation of the rotatable member and are discharged from the discharge port, which radially extends across the axial end surface of the ring portion. With this construction, it is possible to alleviate the disadvantages associated with the intrusion of the contaminants in the axial slide gap.

However, as discussed above, the portion of the pump flow passage radially extends across the axial end surface of the ring portion, so that the pressurized fuel flows into not only the discharge port but also into the radial gap between the outer peripheral wall surface of the ring portion and the inner peripheral wall surface of the receiving portion. This radial gap is also communicated with the pump flow passage, so that the pump efficiency may possibly be deteriorated.

SUMMARY OF THE INVENTION

The present invention addresses the above disadvantages. According to the present invention, there is provided a fuel pump that draws fuel and discharges the drawn fuel after pressurizing the drawn fuel. The fuel pump includes a rotatable member and a flow passage member. The rotatable member is configured into a generally circular disk form and includes a plurality of blades, which are arranged one after another in a circumferential direction, and a ring portion, which is annular and is placed radially outward of the plurality of blades. The flow passage member includes a receiving portion, a flow passage groove, a suction port and a discharge port. The receiving portion rotatably receives the rotatable member. The flow passage groove forms a pump flow passage that conducts the fuel in a rotational direction of the rotatable member and pressurizes the fuel in cooperation with the rotatable member upon rotation of the rotatable member. The flow passage groove is configured into an arcuate form arcuately extending in the circumferential direction and is axially recessed in an inner wall surface of the receiving portion to axially oppose an axial end surface of the rotatable member. The suction port is communicated with the pump flow passage to draw the fuel into the pump flow passage through the suction port. The discharge port is communicated with the pump flow passage to discharge the pressurized fuel out of the pump flow passage through the discharge port. An enlarged space is formed in a slide surface, which is provided in the inner wall surface of the receiving portion and along which an axial end surface of the ring portion slides upon the rotation of the rotatable member. The enlarged space is placed in a predetermined circumferential range of the slide surface that circumferentially extends from one circumferential point to another circumferential point on the slide surface. The one circumferential point on the slide surface is located radially outward of a front side end part of the suction port along a first imaginary radial line, which radially extends from a rotational axis of the rotatable member through the front side end part of the suction port. The front side end part of the suction port is located at a front side end of the suction port in the rotational direction of the rotatable member. The another circumferential point on the slide surface is located radially outward of a predetermined location of the pump flow passage along a second imaginary radial line, which radially extends from the rotational axis of the rotatable member through the predetermined location of the pump flow passage. A fuel pressure at the predetermined location of the pump flow passage is generally equal to a fuel pressure in a corresponding location of a radial gap, which is located radially outward of the predetermined location of the pump flow passage along the second imaginary radial line and is formed between an outer peripheral wall surface of the ring portion and an inner peripheral wall surface of the receiving portion, upon the rotation of the rotatable member. The enlarged space is communicated with the pump flow passage and has an axial gap size, which is axially measured between an axial bottom surface of the enlarged space and the axial end surface of the ring portion and is larger than that of an axial slide gap between the slide surface and the axial end surface of the ring portion.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

Figure 1:
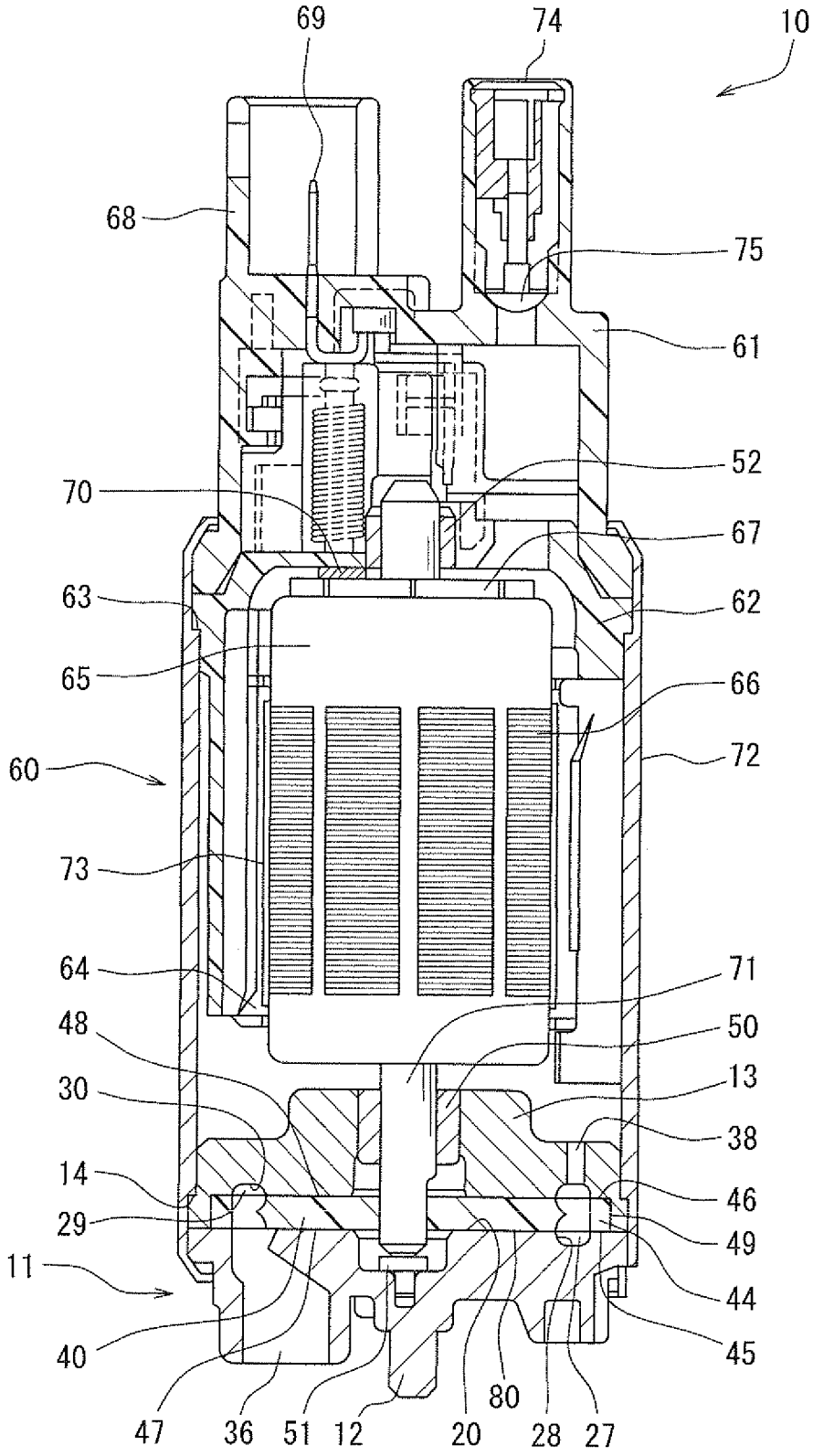
FIG. 1 is a schematic cross sectional view of a fuel pump according to a first embodiment of the present invention, showing an entire structure of the fuel pump.

Embodiments of the present invention will be described with reference to the accompanying drawings. In the following embodiments, similar components will be indicated by the same reference numerals and will not be repeatedly described in the subsequent embodiments.

(First Embodiment)

Now, a first embodiment of the present invention will be described with reference to FIGS. 1 to 5.

A fuel pump 10 is an in-tank turbine pump, which is received in an undepicted fuel tank that is installed to a vehicle (e.g., a motorcycle or a four wheel automobile). The fuel pump 10 draws fuel out of the fuel tank and pumps the drawn fuel toward an internal combustion engine.

As shown in FIG. 1, the fuel pump 10 includes a pump device 11 and a motor device 60. The motor device 60 drives the pump device 11.

A housing 72, which is configured into a generally cylindrical tubular body, serves as both a housing of the pump device 11 and a housing of the motor device 60. The housing 72 holds a cover 12 of the pump device 11 at one axial end thereof and an end cover 61 at the other axial end thereof by swaging (i.e., by radially inwardly bending one axial end part of the housing 72 against the cover 12 and radially inwardly bending the other axial end part of the housing 72 against the end cover 61). When the housing 72 holds the cover 12 by the swaging, a casing main body 13 is clamped between the cover 12 and a step 14 of the housing 72. Furthermore, when the housing 72 holds the end cover 61 by the swaging, a bearing holder 62 is clamped between the end cover 61 and a step 63 of the housing 72. The bearing holder 62 and the end cover 61 are made of a resin material.

The motor device 60 is a brushed direct current (DC) motor and includes a plurality of arcuate permanent magnets 64 and an armature 65. The permanent magnets 64 are secured to an inner peripheral wall surface of the housing 72 and are arranged one after another in a circumferential direction along the inner peripheral wall surface of the housing 72. The armature 65 is placed radially inward of the permanent magnets 64.

The armature 65 is rotatably received in the motor device 60. Furthermore, coils are wound around a core 66 in the armature 65. A commutator 67 having commutator segments is configured into a generally circular disk form and is placed at a top part of the armature 65. An electric power is supplied from an undepicted electric power source to the coils through terminals 69 of a connector 68 (the terminals 69 being embedded in resin of the connector 68), brushes 70 and the commutator 67. When the armature 65 is rotated by supplying the electric power thereto, a rotatable shaft 71 of the armature 65 is rotated together with an impeller (serving as a rotatable member) 40.

Figure 2:
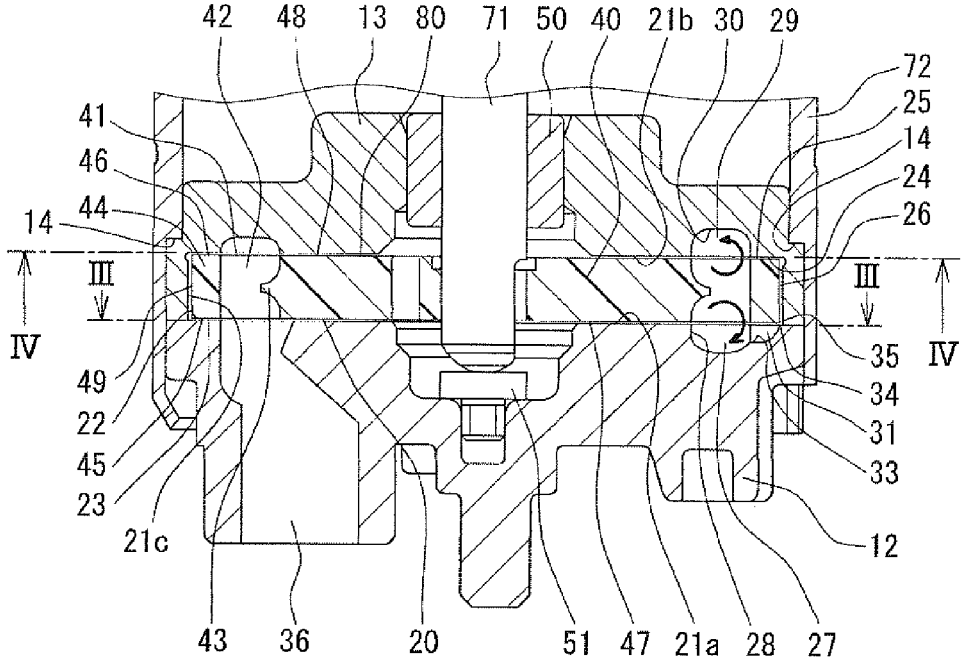
FIG. 2 is partial cross sectional view showing a pump device of the fuel pump of FIG. 1.

With reference to FIGS. 1 and 2, the pump device 11 includes the impeller 40, the casing main body 13 and the cover 12. The impeller 40 is made of a resin material and is configured into a generally circular disk form. The impeller 40 includes a plurality of blades 41, a plurality of blade grooves (blade-to-blade gaps) 42 and an annular ring portion 44. The blades 41 radially outwardly extend from a main body 80 of the impeller 40 and are placed one after another in a circumferential direction all around the impeller 40. Each of the blade grooves 42 is formed between corresponding circumferentially adjacent two of the blades 41. The ring portion 44 is configured into a generally annular body and is placed radially outward of the blades 41. The impeller 40 also includes a plurality of protrusions 43, each of which is provided in a corresponding one of the blade grooves 42. Specifically, each protrusion 43 protrudes from an axial center part of a radially inner end wall surface of the corresponding blade groove 42 toward an inner peripheral wall surface of the ring portion 44.

The casing main body 13 and the cover 12 are made by, for example, aluminum die-casting. As shown in FIG. 1, when the casing main body 13 and the cover 12 are assembled together, a receiving portion (receiving chamber) 20 is formed therebetween to rotatably receive the impeller 40.

The casing main body 13 is securely press fitted to the inner peripheral wall surface of the end part of the housing 72, and a bearing 50 is installed to a center of the casing main body 13. The cover 12 is fixed to the one end part of the housing 72 by bending the one end part of the housing 72 against the cover 12 in the state where the cover 12 is installed to the casing main body 13. A thrust bearing 51 is press fitted to a center of the cover 12.

One end part of the rotatable shaft 71 of the armature 65 is rotatably supported by the bearing (radial bearing) 50, and the axial load of the rotatable shaft 71 is supported by the thrust bearing 51. The other axial end part of the rotatable shaft 71 is rotatably supported by the bearing (radial bearing) 52.

Figure 3:
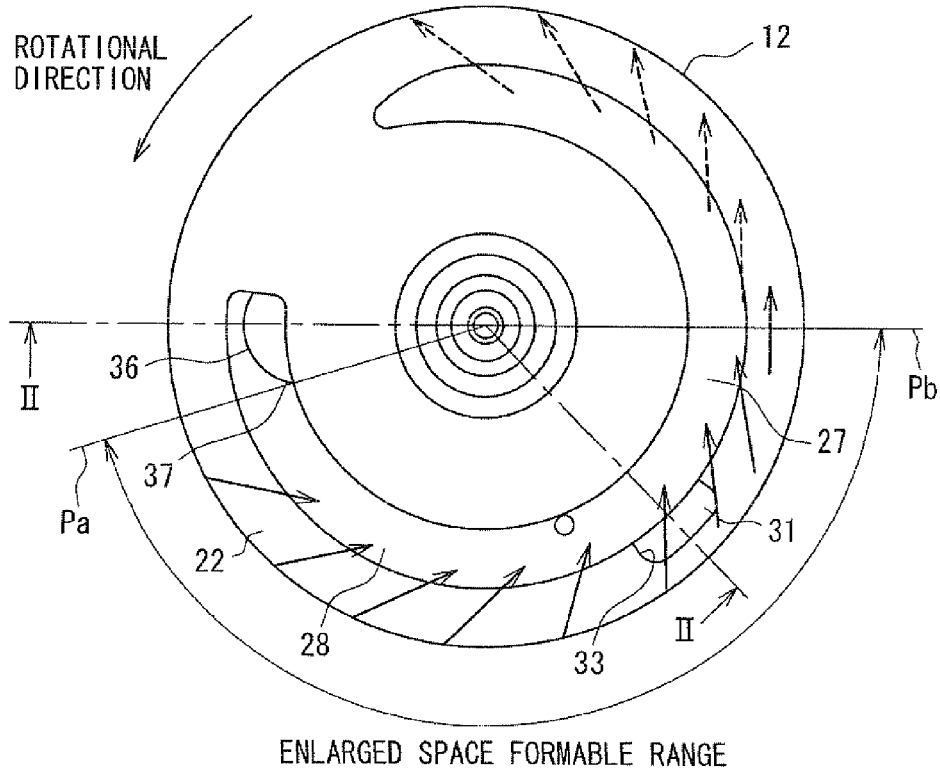
FIG. 3 is a cross sectional view taken along line III-III in FIG. 2.

As shown in FIGS. 2 and 3, a cover side pump flow passage (serving as a first pump flow passage) 27 is formed in the cover 12 to extend in the circumferential direction, along which the blades 41 are placed one after another. More specifically, the cover side pump flow passage 27 is configured into an arcuate form (a C-shaped form) arcuately extending in the circumferential direction and is axially opposed to a cover 12 side axial end surface (serving as a first axial end surface) of the impeller 40. The cover side pump flow passage 27 is communicated with the blade grooves 42.

In the present embodiment, the cover side pump flow passage 27 is formed by a cover side flow passage groove (serving as a first flow passage groove) 28. The cover side flow passage groove 28 is formed in a cover 12 side inner wall surface (serving as a first side inner wall surface) 21*a* of the receiving portion 20 (also referred to as an inner wall surface 21*a* of the cover 12), which is axially opposed to the cover 12 side axial end surface of the impeller 40. Furthermore, as shown in FIGS. 2 and 3, a suction port (inlet) 36 is connected to the cover side pump flow passage 27 to draw fuel therethrough. An outlet end of the suction port 36 opens to a rear side end part (an upstream side end part) of the cover side flow passage groove 28, which is located at a rear side end of the cover side flow passage groove 28 in the rotational direction of the impeller 40. An inlet end of the suction port 36 is opened in an outer surface of the cover 12. The inlet end of the suction port 36 is connected to an undepicted fuel filter. The fuel filter removes relatively large contaminants (e.g., debris, foreign particles) contained in the fuel.

Figure 4:
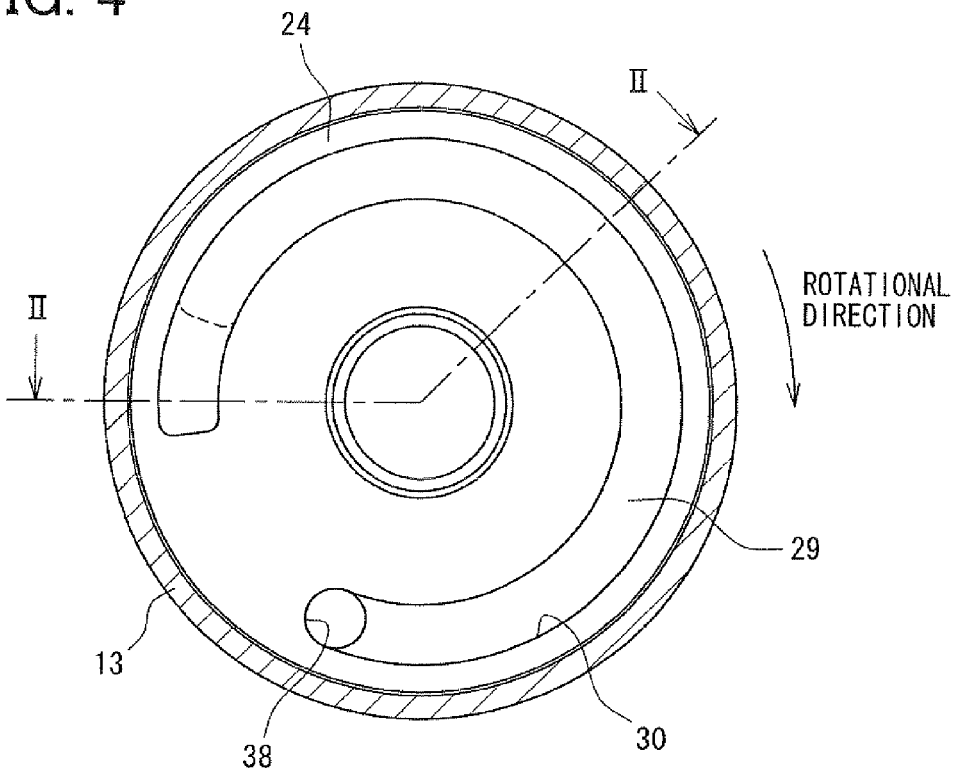
FIG. 4 is a cross sectional view taken along line IV-IV in FIG. 2.

As shown in FIGS. 2 and 4, similar to the cover 12, a main body side pump flow passage (serving as a second pump flow passage) 29 is formed in the casing main body 13 to extend in the circumferential direction, along which the blades 41 are placed one after another. More specifically, the main body side pump flow passage 29 is configured into the arcuate form (the C-shaped form) arcuately extending in the circumferential direction and is axially opposed to a casing main body 13 side axial end surface (serving as a second axial end surface) of the impeller 40. The main body side pump flow passage 29 is communicated with the blade grooves 42 and is also communicated with the cover side pump flow passage 27 through the blade grooves 42.

In the present embodiment, the main body side pump flow passage 29 is formed by a main body side flow passage groove (serving as a second flow passage groove) 30. The main body side flow passage groove 30 is formed in a casing main body 13 side inner wall surface (serving as a second side inner wall surface) 21*b* of the receiving portion 20 (also referred to as an inner wall surface 21*b* of the casing main body 13), which is axially opposed to the casing main body 13 side axial end surface of the impeller 40. Furthermore, with reference to FIGS. 2 and 4, a discharge port 38 is connected to the main body side pump flow passage 29 to discharge the fuel, which has been pressurized in the main body side pump flow passage 29 and the cover side pump flow passage 27. An inlet end of the discharge port 38 is opened to a front side end part (a downstream side end part) of the main body side flow passage groove 30, which is located at a front side end of the main body side flow passage groove 30 in the rotational direction of the impeller 40. An outlet end of the discharge port 38 is opened in the outer surface of the casing main body 13 to discharge the fuel into the interior of the housing 72. The circumferential location of the rear side end part and the circumferential location of the front side end part of the cover side flow passage groove 28 substantially coincide with the circumferential location of the rear side end part and the circumferential location of the front side end part, respectively, of the main body side flow passage groove 30.

A cover side slide surface (serving as a first side slide surface) 22 is formed in the inner wall surface 21*a* of the cover 12. A cover 12 side axial end surface (serving as a first axial end surface) 45 of the ring portion 44 slides on the cover side slide surface 22 when the impeller 40 is rotated. An axial slide gap 23 is formed between the cover side slide surface 22 and the cover 12 side axial end surface 45 of the ring portion 44.

A main body side slide surface (serving as a second side slide surface) 24 is formed in the inner wall surface 21*b* of the casing main body 13. A casing main body 13 side axial end surface (serving as a second axial end surface) 46 of the ring portion 44 slides on the main body side slide surface 24 when the impeller 40 is rotated. An axial slide gap 25 is formed between the main body side slide surface 24 and the casing main body 13 side axial end surface 46 of the ring portion 44.

The axial end surfaces 47, 48 of the main body 80 of the impeller 40, which are located radially inward of the blades 41 and the blade grooves 42 of the impeller 40, also slide on the inner wall surfaces 21*a*, 21*b* of the receiving portion 20 upon the rotation of the impeller 40. A radial gap 26 is radially formed between the outer peripheral wall surface 49 of the ring portion 44 of the impeller 40 and an inner peripheral wall surface 21*c* of the receiving portion 20 (also referred to as an inner peripheral wall surface 21*c* of the casing main body 13).

Next, a pressurization operation of the fuel pump 10 will be described.

With reference to FIG. 2, which is the view taken along line II-II in FIG. 3 or taken along line II-II in FIG. 4, when the impeller 40 is rotated integrally with the rotatable shaft 71 upon rotation of the armature 65, fuel is drawn from the suction port 36 into the cover side pump flow passage 27 and the main body side pump flow passage 29. The fuel, which is drawn into the pump flow passages 27, 29, forms two swirl flows, which are created on one axial side and the other axial side, respectively, of the corresponding protrusion 43, as indicated by clockwise and counterclockwise arrows in FIG. 2. The fuel, which is drawn into the cover side pump flow passage 27, flows in a direction of the clockwise arrow in FIG. 2 from the bottom side (the cover 12 side of the protrusion 43) of the radially inner end part of the corresponding blade groove 42 along the arcuate surface of the protrusion 43 toward the radially outer end part of the corresponding blade groove 42. Then, the fuel, which has reached the radially outer end part of the corresponding blade groove 42, collides against the inner peripheral wall surface of the ring portion 44 and is downwardly discharged into the cover side flow passage groove 28.

The fuel, which is supplied into the cover side flow passage groove 28, flows along the cover side flow passage groove 28 and is then supplied to the radially inner end part of the following blade groove 42, which is located on the rear side in the rotational direction of the impeller 40 (i.e., on the clockwise side in FIG. 3) of the previous blade groove 42. In contrast, the fuel, which is drawn into the main body side pump flow passage 29, flows in a direction of the counterclockwise arrow shown in FIG. 2 from the top side (the casing main body 13 side of the protrusion 43) of the radially inner end part of the corresponding blade groove 42 along the arcuate surface of the protrusion 43 toward the radially outer end part of the corresponding blade groove 42. Then, the fuel, which has reached the radially outer end part of the corresponding blade groove 42, collides against the inner peripheral wall surface of the ring portion 44 and is upwardly discharged into the main body side flow passage groove 30. The fuel, which is supplied into the main body side flow passage groove 30, flows along the main body side flow passage groove 30 and is then supplied to the radially inner end part of the following blade groove 42, which is located on the rear side of the previous blade groove 42 in the rotational direction of the impeller 40.

As discussed above, the fuel, which is drawn into the pump flow passages 27, 29, forms the two swirl flows, which are created on one axial side and the other axial side, respectively, of the corresponding protrusion 43 by repeatedly flowing from the pump flow passage 27, 29 into the blade groove 42 and then flowing back to the pump flow passage 27, 29, and so on. These swirl flows are gradually pressurized to the higher pressure as they proceed in the respective pump flow passages 27, 29 toward the front side (the downstream side) in the rotational direction of the impeller 40.

Now, with reference to FIG. 5, there will be described a relationship between the fuel pressure in the respective pump flow passages 27, 29 and the fuel pressure in the radial gap 26 between the outer peripheral wall surface 49 of the ring portion 44 and the inner peripheral wall surface 21*c* of the receiving portion 20.

Here, the relationship between the fuel pressure in the cover side pump flow passage 27 and the fuel pressure in the radial gap 26 will be described. The fuel pressure in the main body side pump flow passage 29 is substantially the same as the fuel pressure in the cover side pump flow passage 27. Therefore, the description of the relationship between the fuel pressure in the main body side pump flow passage 29 and the fuel pressure in the radial gap 26 will not be described for the sake of simplicity.

The cover side pump flow passage 27 is configured into the arcuate form, which is coaxial with the center of the cover 12 (the rotational axis of the impeller 40). Therefore, each corresponding location of the cover side pump flow passage 27 will be described as an angle (hereinafter, referred to as a flow passage angle) of a corresponding radial line, which radially connects between a corresponding location in the pump flow passage 27 and the center of the cover 12 (the rotational axis of the impeller 40), relative to a reference line, which radially connects between a center of the suction port 36 and the center of the cover 12, in the rotational direction of the impeller 40.

Figure 5:
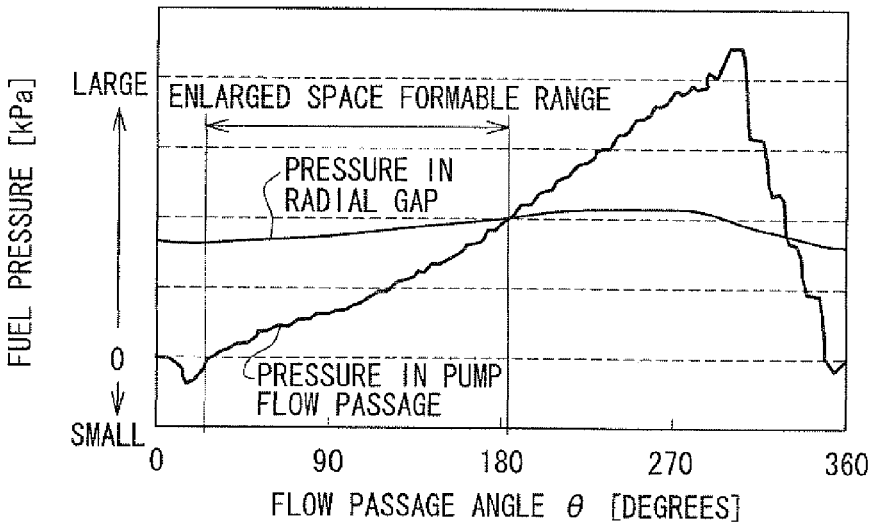
FIG. 5 is a diagram showing a relationship between a fuel pressure in a pump flow passage and a fuel pressure in a radial gap in the fuel pump of FIG. 1.

As shown in FIG. 5, when the impeller 40 is rotated in the rotational direction indicated by the arrow in FIG. 3, the fuel, which is drawn through the suction port 36, is guided in the cover side pump flow passage 27 toward the discharge port 38 while forming the swirl flows discussed above. As shown in FIG. 5, the fuel pressure in the cover side pump flow passage 27 is progressively increased from the suction port 36 side toward the discharge port 38 side. The fuel pressure is maximized at a location where the flow passage angle θ is about 300 degrees.

In a range where the flow passage angle θ is between 300 to 360 degrees, the fuel pressure indicated in FIG. 5 is the fuel pressure in the axial slide gap between the axial end surface of the blades 41 of the impeller 40 and the inner wall surface 21*a* of the receiving portion 20.

Since the radial gap 26 circumferentially extends along the entire circumference of the impeller 40, the fuel pressure in the radial gap 26 is generally constant.

As shown in FIG. 5, in a predetermined circumferential range of the flow passage angle θ from 0 degrees to about 180 degrees, the fuel pressure in the cover side pump flow passage 27 is less than the fuel pressure in the radial gap 26. At the location of about 180 degrees, the fuel pressure in the cover side pump flow passage 27 is generally equal to the fuel pressure in the radial gap 26. In a subsequent circumferential range of the flow passage angle θ that is larger than about 180 degrees, the fuel pressure in the cover side pump flow passage 27 is larger than the fuel pressure in the radial gap 26.

Specifically, in the predetermined circumferential range where the fuel pressure in the cover side pump flow passage 27 is less than the fuel pressure in the radial gap 26, the fuel in the radial gap 26 flows into the cover side pump flow passage 27 through the axial slide gap 23 (see solid arrows shown in FIG. 3, indicating the flow direction of the fuel).

In contrast, when the fuel pressure in the pump flow passage 27 is larger than the fuel pressure in the radial gap 26, the fuel in the pump flow passage 27 flows into the radial gap 26 through the axial slide gap 23 (see dotted arrows shown in FIG. 3, indicating the flow direction of the fuel).

At the front side end part (the downstream end part) of the pump flow passages 27, 29, the pressurized fuel is discharged from the discharge port 38. When the pressurized fuel is discharged from the discharge port 38, the impeller 40 receives a reaction force, which is generated in response to the discharging of the pressurized fuel through the discharge port 38. The impeller 40 is urged by this reaction force against the inner wall surface 21*a* of the receiving portion 20 on the cover 12 side.

The fuel, which is discharged from the discharge port 38, flows through each corresponding circumferential gap between corresponding adjacent two of the permanent magnets 64 and also through a fuel passage 73 between the inner peripheral surfaces of the permanent magnets 64 and the outer peripheral surface of the armature 65 and is outputted from the fuel pump 10 through an outlet port 74 toward the engine side.

As discussed above, the pressurized fuel, which is pressurized in the pump device 11, flows through the interior of the motor device 60. Therefore, the fuel cools the motor device 60 and lubricates the slidable component(s) in the motor device 60.

A check valve 75 is received in the outlet port 74 to limit a backflow of the fuel discharged from the outlet port 74.

In the present embodiment, the impeller 40 is constructed as follows. That is, when the impeller 40 is rotated, the axial end surfaces 47, 48 of the main body 80 and the axial end surfaces 45, 46 of the ring portion 44 slide along the inner wall surfaces 21*a*, 21*b* of the receiving portion 20. Therefore, the fluid tightness of the cover side pump flow passage 27 and of the main body side pump flow passage 29 can be improved.

Therefore, a pump efficiency is improved. The pump efficiency is expressed by (P×Q)/(T×N). In this equation, "T" denotes a torque of the motor device 60, and "N" denotes a rotational speed of the motor device 60. Furthermore, "P" denotes a fuel pressure of the discharged fuel, and "Q" denotes the amount of the discharged fuel.

Now, characteristic features of the present embodiment will be described with reference to FIGS. 2, 3 and 5.

As shown in FIGS. 2 and 3, an enlarged space 31 is formed in the cover side slide surface 22 and is radially communicated with the cover side pump flow passage 27 through a radial opening of the enlarged space 31. The enlarged space 31 has a predetermined circumferential extent. The enlarged space 31 has an axial gap size (axial distance), which is axially measured between an axial bottom surface of the enlarged space 31 and the axial end surface 45 of the ring portion 44 and is larger than that of the axial slide gap 23 between the cover side slide surface 22 and the axial end surface 45 of the ring portion 44. A circumferential extent of the enlarged space 31 is set to be a predetermined length. With reference to FIGS. 3 and 5, the enlarged space 31 is placed in a predetermined circumferential range (enlarged space formable range) of the cover side slide surface 22 that circumferentially extends from one circumferential point to another circumferential point on the cover side slide surface 22. The one circumferential point on the cover side slide surface 22 is located radially outward of a front side end part 37 of the suction port 36 along a first imaginary radial line Pa, which radially extends from the rotational axis of the rotatable member 40 (the center of the cover 12) through the front side end part 37 of the suction port 36. The front side end part 37 of the suction port 36 is located at a front side end of the suction port 36 in the rotational direction of the impeller 40. The another circumferential point on the cover side slide surface 22 is located radially outward of a predetermined location of the cover side pump flow passage 27 along a second imaginary radial line Pb, which radially extends from the rotational axis of the rotatable member 40 through the predetermined location of the cover side pump flow passage 27. A fuel pressure at the predetermined location of the cover side pump flow passage 27 is generally equal to a fuel pressure in a corresponding location of the radial gap 26, which is located radially outward of the predetermined location of the cover side pump flow passage 27 along the second imaginary radial line Pb, upon the rotation of the rotatable member 40.

In the present embodiment, the enlarged space 31 is formed by a recessed groove 33, which is recessed in the cover side slide surface 22 in the axial direction that is opposite from the impeller 40 and radially inwardly opens to the cover side flow passage groove 28. Two opposed circumferential ends of the recessed groove 33 are both located within the above described enlarged space formable range.

In this particular embodiment, with reference to FIG. 5, the recessed groove 33 is formed within the circumferential range of the flow passage angle θ from 90 degrees to 180 degrees. As shown in FIG. 2, a radial location of an outer peripheral edge 34 of the recessed groove 33 generally coincides with a radial location of an outer peripheral edge of the ring portion 44.

Next, the advantages of the enlarged space 31 will be described.

As discussed above, when the impeller 40 is rotated, a pressure difference is generated between the cover side pump flow passage 27 and the radial gap 26. Therefore, the fuel flow is created in the axial slide gap 23. Therefore, the contaminants (e.g., debris, foreign particles) contained in the fuel may be drawn into the axial slide gap 23.

When the impeller 40 is rotated, the contaminants, which are drawn into the axial slide gap 23, are dragged in the rotational direction of the impeller 40 in the axial slide gap 23. The contaminants, which are dragged in the rotational direction of the impeller 40 in the axial slide gap 23, are discharged into the enlarged space 31 that has the larger axial gap size in comparison to that of the axial slide gap 23.

The enlarged space 31 is formed within the above described circumferential range, so that the fuel flow is created from the radial gap 26 toward the pump flow passage 27 through the enlarged space 31. Therefore, the contaminants, which are discharged into the enlarged space 31, are carried by this fuel flow without being entering into the axial slide gap 23 once again on the downstream side of the enlarged space 31 and are discharged out of the fuel pump 10 after passing through the discharge port 38.

With this construction, the contaminants, which are drawn into the axial slide gap 23, can be quickly discharged out of the axial slide gap 23 through the enlarged space 31. Thereby, the discharging capability for discharging the contaminants out of the fuel pump 10 can be improved.

Furthermore, the fuel flow from the radial gap 26 toward the pump flow passage 27 is created through the enlarged space 31, so that it is possible to limit the flow of the pressurized fuel, which has been pressurized before reaching the enlarged space 31, into the radial gap 26 at this circumferential location.

Even when the enlarged space 31 is formed in the above described location, it is possible to limit a reduction in the fluid tightness of the pump flow passage 27. Therefore, it is possible to limit the reduction in the pump efficiency, which is expressed by (P×Q)/(T×N), in comparison to the prior art technique.

As described above, when the enlarged space 31 is formed in the above-described location in the cover side slide surface 22, it is possible to provide the fuel pump 10 that can improve the discharging performance for discharging the contaminants without deteriorating the fluid tightness of the pump flow passage 27.

Furthermore, according to the present embodiment, the enlarged space 31 is formed by the recessed groove 33. The enlarged space 31, which can provide the above-described advantage, can be formed by simply adding the recessed groove 33 to the cover 12.

Furthermore, in the present embodiment, the recessed groove 33 is formed such that the radial location of the outer peripheral edge 34 of the recessed groove 33 generally coincides with the radial location of the outer peripheral edge 35 of the ring portion 44. With this construction, the contaminants, which are drawn into the axial slide gap 23, can be effectively discharged into the enlarged space 31.

In the present embodiment, the discharge port 38 is formed in the casing main body 13. As discussed above, when the fuel, which is pressurized in the pump flow passages 27, 29, is discharged through the discharge port 38, the reaction force is applied to the impeller 40. The reaction force is directed in the direction, which is opposite from the discharging direction of the fuel, i.e., which is toward the cover 12. The impeller 40 is rotated while being urged by this reaction force against the inner wall surface 21*a* of the receiving portion 20 on the cover 12 side. Thereby, the axial gap size of the axial slide gap 23 becomes smaller than that of the axial slide gap 25 (see FIG. 2). When the axial gap size of the axial slide gap becomes smaller, it becomes more difficult to discharge the contaminants, which are drawn into the axial slide gap, out of the axial slide gap.

In the present embodiment, as discussed above, the axial slide gap 23 is provided on the cover side slide surface 22, so that the contaminants can be effectively discharged from the axial slide gap 23 through the enlarged space 31.

(Second Embodiment)

Figure 6:
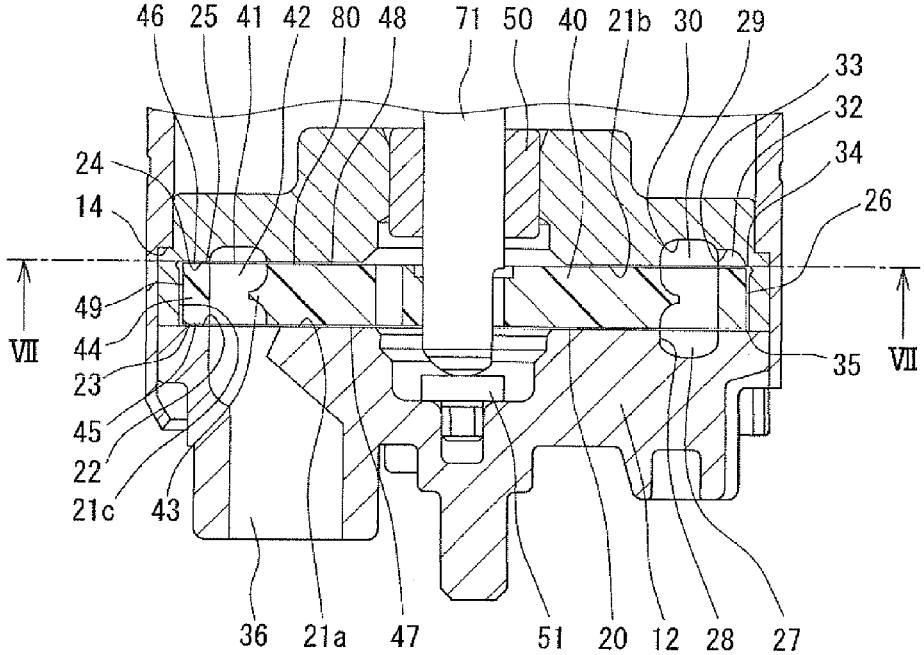
FIG. 6 is a cross-sectional view showing a structure of a pump device of a fuel pump according to a second embodiment of the present invention.
Figure 7:
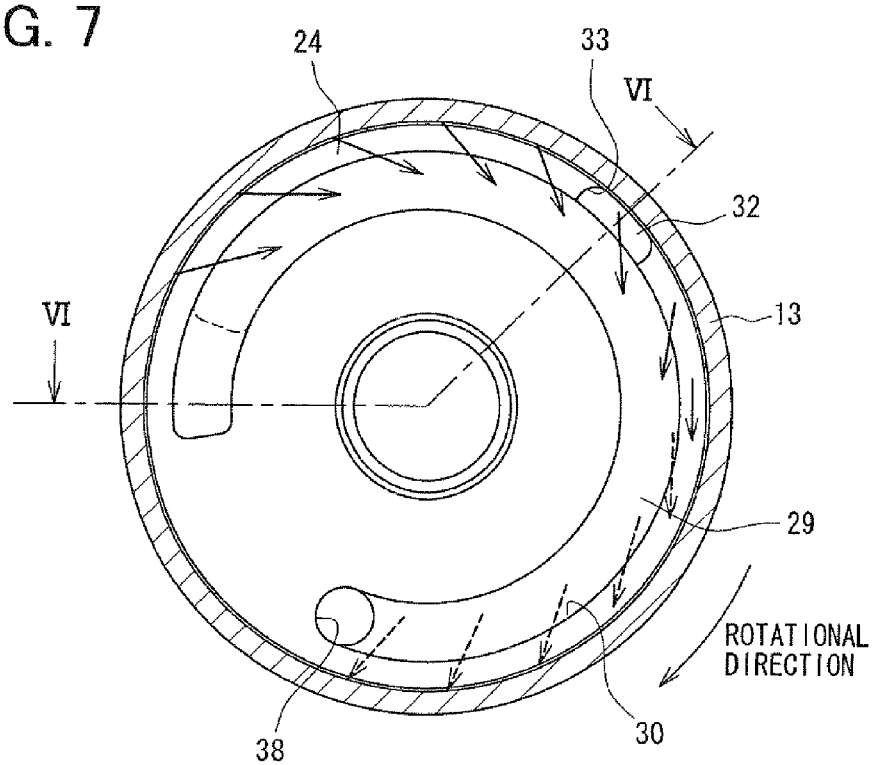
FIG. 7 is a cross sectional view taken along line VII-VII in FIG. 6.

A second embodiment of the present invention is a modification of the first embodiment. In the second embodiment, an enlarged space 32 is provided to the main body side slide surface 24 of the casing main body 13 unlike the first embodiment, in which the enlarged space 31 is provided to the cover side slide surface 22 of the cover 12. FIG. 6 shows a cross-sectional view of the pump device 11 of the fuel pump 10 of the second embodiment, and FIG. 7 shows a cross-sectional view along line VII-VII in FIG. 6. FIG. 6 is the cross sectional view along line VI-VI in FIG. 7.

As shown in FIGS. 6 and 7, similar to the enlarged space 31 of the first embodiment, an enlarged space 32 is placed in a predetermined circumferential range of the main body side slide surface 24 that circumferentially extends from one circumferential point to another circumferential point on the main body side slide surface 24. The one circumferential point on the main body side slide surface 24 is located radially outward of the front side end part 37 of the suction port 36 along the first imaginary radial line, which radially extends from the rotational axis of the rotatable member 40 through the front side end part 37 of the suction port 36. The another circumferential point on the main body side slide surface 24 is located radially outward of a predetermined location of the main body side pump flow passage 29 along the second imaginary radial line, which radially extends from the rotational axis of the rotatable member 40 (the center of the casing main body 13) through the predetermined location of the main body side pump flow passage 29. The fuel pressure at the predetermined location of the main body side pump flow passage 29 is generally equal to the fuel pressure in the corresponding location of the radial gap 26, which is located radially outward of the predetermined location of the main body side pump flow passage 29 along the second imaginary radial line, upon the rotation of the rotatable member 40.

Even when the enlarged space 32 is formed in the main body side slide surface 24, advantages, which are similar to those discussed in the first embodiment, can be achieved.

(Third Embodiment)

Figure 8:
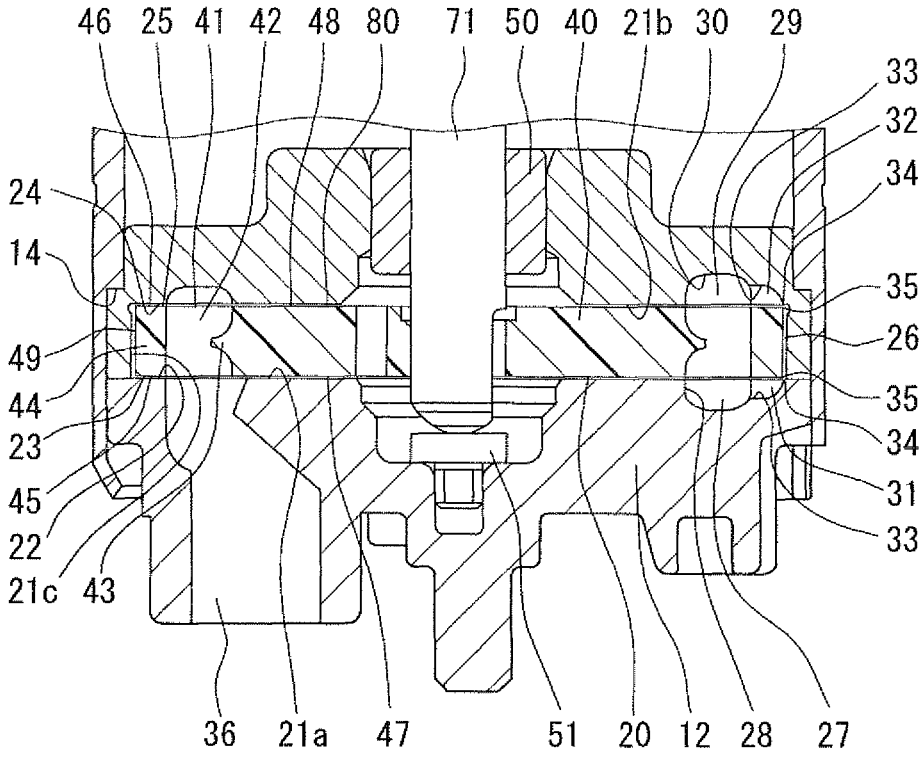
FIG. 8 is a cross-sectional view showing a structure of a pump device of a fuel pump according to a third embodiment of the present invention.

A third embodiment of the present invention is a modification of the first embodiment. In the third embodiment, in addition to the enlarged space 31 formed in the cover side slide surface 22, the enlarged space 32 discussed in the second embodiment is formed in the main body side slide surface 24. FIG. 8 shows a cross section of the pump device 11 of the fuel pump 10 according to the third embodiment of the present invention.

As shown in FIG. 8, the enlarged space 31, 32 may be formed in both of the cover 12 side slide surface 22 and the main body side slide surface 24. In this way, the discharging capability for discharging the contaminants out of the fuel pump 10 can be further improved.

In the present embodiment, the circumferential location of the enlarged space 31 is the same as the circumferential location of the enlarged space 32. Alternatively, the circumferential location of the enlarged space 31 may be displaced from the circumferential location of the enlarged space 32.

Additional advantages and modifications will readily occur to those skilled in the art. The invention in its broader terms is therefore not limited to the specific details, representative apparatus, and illustrative examples shown and described.

What is claimed is:

1. A fuel pump that draws fuel and discharges the drawn fuel after pressurizing the drawn fuel, the fuel pump comprising:

a rotatable member that is configured into a generally circular disk form and includes a plurality of blades, which are arranged one after another in a circumferential direction, and a ring portion, which is annular and is placed radially outward of the plurality of blades; and a flow passage member that includes:

a receiving portion, which rotatably receives the rotatable member;

a flow passage groove, which forms a pump flow passage that conducts the fuel in a rotational direction of the rotatable member and pressurizes the fuel in cooperation with the rotatable member upon rotation of the rotatable member, wherein the flow passage groove is configured into an arcuate form arcuately extending in the circumferential direction and is axially recessed in an inner wall surface of the receiving portion to axially oppose an axial end surface of the rotatable member;

a suction port, which is communicated with the pump flow passage to draw the fuel into the pump flow passage through the suction port; and a discharge port, which is communicated with the pump flow passage to discharge the pressurized fuel out of the pump flow passage through the discharge port, wherein:

an enlarged space is formed in a slide surface, which is provided in the inner wall surface of the receiving portion and along which an axial end surface of the ring portion slides upon the rotation of the rotatable member;

the enlarged space is placed in a predetermined circumferential range of the slide surface that circumferentially extends from one circumferential point to another circumferential point on the slide surface;

the one circumferential point on the slide surface is located radially outward of a front side end part of the suction port along a first imaginary radial line, which radially extends from a rotational axis of the rotatable member through the front side end part of the suction port, and the front side end part of the suction port is located at a front side end of the suction port in the rotational direction of the rotatable member;

the another circumferential point on the slide surface is located radially outward of a predetermined location of the pump flow passage along a second imaginary radial line, which radially extends from the rotational axis of the rotatable member through the predetermined location of the pump flow passage, and a fuel pressure at the predetermined location of the pump flow passage is generally equal to a fuel pressure in a corresponding location of a radial gap, which is located radially outward of the predetermined location of the pump flow passage along the second imaginary radial line and is formed between an outer peripheral wall surface of the ring portion and an inner peripheral wall surface of the receiving portion, upon the rotation of the rotatable member;

the enlarged space is communicated with the pump flow passage and has an axial gap size, which is axially measured between an axial bottom surface of the enlarged space and the axial end surface of the ring portion and is larger than that of an axial slide gap between the slide surface and the axial end surface of the ring portion; and a radially outer of the flow passage groove, which forms the pump flow passage, is radially outwardly recessed on a downstream side of the suction port to form the enlarged space.

2. The fuel pump according to claim 1, wherein the enlarged space is formed by a recessed groove, which is axially recessed in the slide surface in a direction opposite from the rotatable member and is communicated with the pump flow passage through a radial opening thereof.

3. The fuel pump according to claim 2, wherein a radial location of an outer peripheral edge of the recessed groove generally coincides with a radial location of an outer peripheral edge of the ring portion.

4. The fuel pump according to claim 1, wherein:

the flow passage groove and the pump flow passage are a first flow passage groove and a first pump flow passage, respectively;

the inner wall surface of the receiving portion is a first side inner wall surface of the receiving portion;

the axial end surface of the rotatable member is a first axial end surface of the rotatable member;

the axial end surface of the ring portion is a first axial end surface of the ring portion;

the flow passage member further includes a second flow passage groove, which is connected to the discharge port and forms a second pump flow passage that conducts the fuel in the rotational direction of the rotatable member and pressurizes the fuel in cooperation with the rotatable member upon rotation of the rotatable member; and the second flow passage groove is configured into an arcuate form arcuately extending in the circumferential direction and is axially recessed in a second side inner wall surface of the receiving portion opposite from the first side inner wall surface of the receiving portion to axially oppose a second axial end surface of the rotatable member opposite from the first axial end surface of the rotatable member.

* * * * *